United States Patent [19]

Herring, Jr. et al.

[11] Patent Number: 4,458,605

[45] Date of Patent: Jul. 10, 1984

[54] RAILWAY TRUCK SPRING HEIGHT ADJUSTMENT DEVICE

[75] Inventors: James M. Herring, Jr., Merion Station; Walter S. Eggert, Jr., Huntington Valley, both of Pa.

[73] Assignee: The Budd Company, Troy, Mich.

[21] Appl. No.: 388,305

[22] Filed: Jun. 14, 1982

[51] Int. Cl.[3] ..... B61F 5/50; F16F 1/26; F16M 7/00

[52] U.S. Cl. ..... 105/197 R; 105/199 R; 105/453; 267/3; 267/175; 267/176; 267/177

[58] Field of Search ..... 105/157 R, 182 R, 197 R, 105/199 R, 453; 267/3, 4, 175, 176, 177, 178, 179

[56] References Cited

U.S. PATENT DOCUMENTS

| | | | |
|---|---|---|---|
| 2,576,367 | 11/1951 | Spearman | 105/199 R |
| 3,563,526 | 2/1971 | Mui | 267/179 |
| 3,586,306 | 6/1971 | Reece et al. | 267/175 |

*Primary Examiner*—Howard Beltran

*Attorney, Agent, or Firm*—Edward M. Farrell; Herman Foster; Thomas I. Davenport

[57] ABSTRACT

A pair of adjustment plates are disposed below a mechanical spring which supports a car body. At least one of the adjustment plates include spaced stepped portions to engage a portion of the other plate with the stepped portion engaged determining the height of the car. When the car load is removed from the springs, the relative positions of the plates may be selectively changed to adjust the height of the car body. A shock absorber is connected inside the mechanical spring and removable through the adjustment plates.

1 Claim, 11 Drawing Figures

RAILWAY TRUCK SPRING HEIGHT ADJUSTMENT DEVICE

BACKGROUND OF THE INVENTION

When mechanical springs are used in a railway car, there is generally no levelling or adjustment means included to maintain the height of the car body a predetermined distance from the ground. This is not true when air springs are used to support the car body, in which case levelling valves are operated to control the air in the springs to maintain the car body level at a predetermined distance from the ground.

When trucks are operated over long periods of time, the wheels of the wheel axle units connected thereto tend to wear. As the wheels wear, the height of the car body tends to lower with respect to ground level. Heretofore, when mechanical springs were used, there has generally been no convenient apparatus for adjusting the level of the car body with respect to the track level.

In the past, in order to adjust for variations in the height of the car body to compensate for wheel wear, it was necessary to first disassemble the truck from the car body. Shims then had to be inserted below the springs. The number of shims which had to be added depended upon the amount of wheel wear.

Periodically disassembling a truck from a car body to permit insertion of shims is time consuming and very costly. Loose shims are also inconvenient to use and generally are disgarded after use.

In many cases, shock absorbers are used inside of the mechanical springs. It is desirable to be able to replace these shock absorbers without disturbing the assembly of the car body and truck including the spring arrangement.

OBJECTS OF THE INVENTION

It is an object of this invention to provide apparatus for adjusting the height of a railway car mounted on mechanical springs to compensate for wheel wear.

It is a further object of this invention to provide improved apparatus for adjusting the height of a railway car mounted on mechanical springs without disassembling the truck from the main body of the car.

It is still a further object of this invention to provide an improved mechanical spring arrangement having a shock absorber within the spring in which the shock absorber may be readily displaced without disassembling the spring or other parts of the truck.

SUMMARY OF THE INVENTION

In accordance with the present invention apparatus are provided for adjusting the height of a railway car to compensate for wear of the wheels in the car. A spring housing is mounted to the truck to receive a mechanical spring therein. Top and bottom adjustment plates may be disposed above or below the spring. At least one of the adjustment plates includes equally spaced stepped portions disposed to face a stepped portion on the other adjustment plate. The other plate may be rotatably mounted to permit it to be selectively moved relative to a selected portion of the plate with the stepped portions. The car load is removed from the spring to permit free relative rotation of the adjustment plates. The adjusted plates provide the desired height for the car body when the load is reapplied.

Other objects and advantages of the present invention will be apparent and suggest themselves to those skilled in the art, from a reading of the following specification and claims, taken in conjunction with the accompanying drawings.

DESCRIPTION OF THE DRAWINGS

FIG. 3 is an enlarged view of a spring arrangement of FIG. 2 illustrating details of the adjustment apparatus of FIG. 2;

DESCRIPTION OF THE INVENTION

Figure 1:
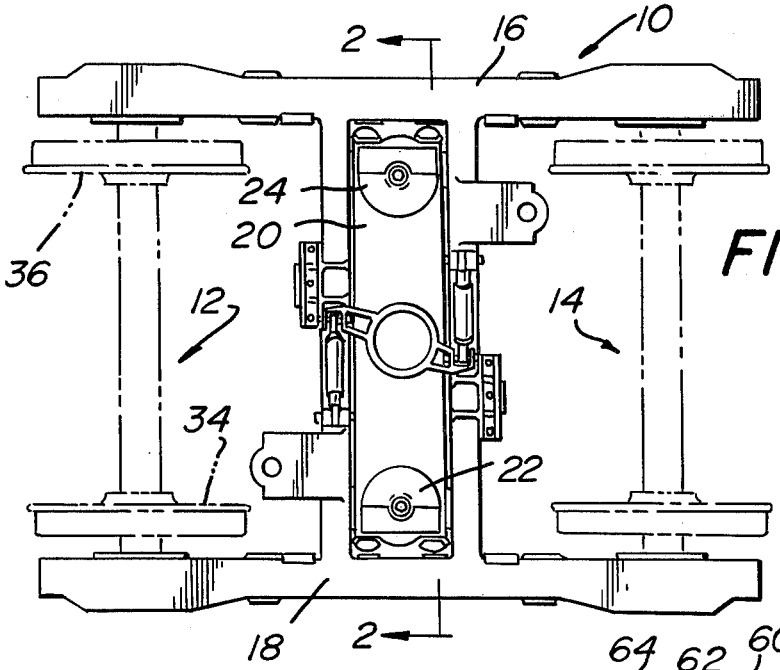
FIG. 1 is a top view of a truck for supporting a railway car of a type utilizing the present invention.

Referring to FIG. 1, a railway truck 10 includes a pair of wheel axle units 12 and 14. A pair of side frames 16 and 18 are disposed to receive the wheel axle units 12 and 14 thereon. A bolster 20 is connected to the side frames 16 and 18 and include spring housings 22 and 24 extending therefrom.

The truck 10 is adapted to carry a railway car body which would normally be disposed on mechanical springs within the spring housings 22 and 24. Because the present invention is primarily directed toward apparatus for adjusting the levels of the car body and its relationships to the mechanical springs within the spring housings 22 and 24, various other additional details relating to the truck 10 will not be illustrated or described in detail. It is understood that the adjustment apparatus to be described may be utilized with a wide variety of conventional trucks other than the one illustrated.

Figure 2:
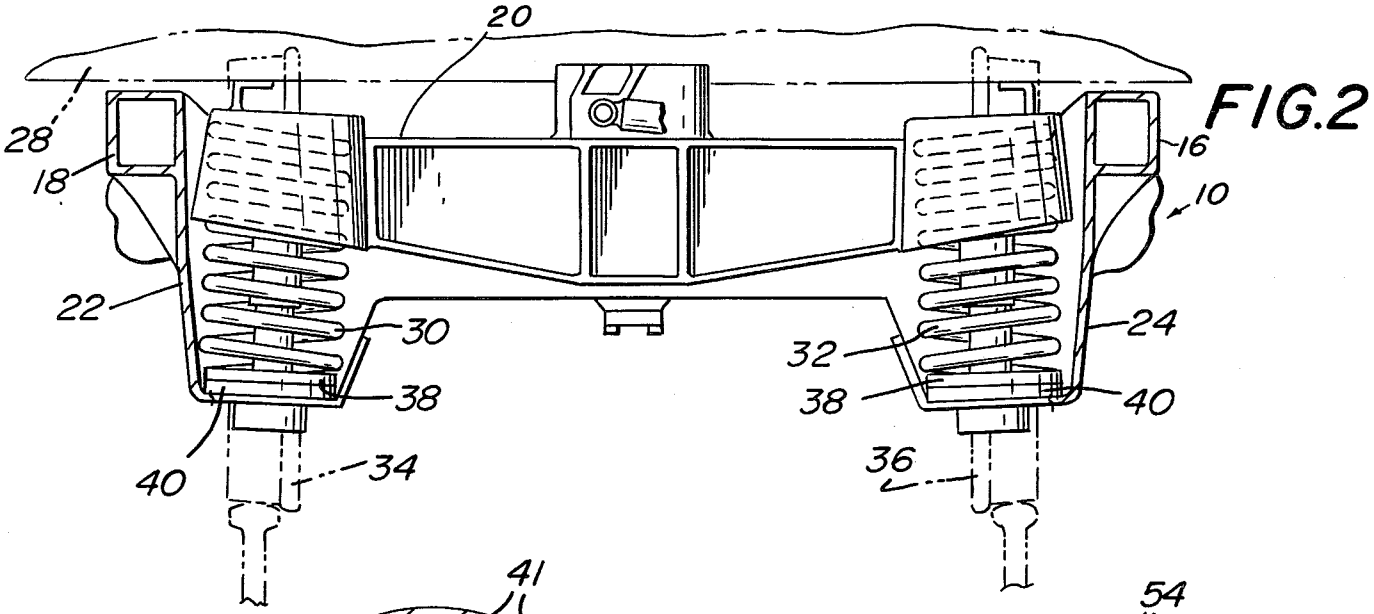
FIG. 2 is a lateral view taken about the center of the truck, illustrating the spring arrangement and adjustment apparatus as employed in the truck of FIG. 1.

Referring to FIG. 2, a car body 28 is adapted to be carried by a pair of mechanical springs 30 and 32 which are disposed within the housings 22 and 24, respectively.

Wheels 34 and 36 form part of the wheel axle unit 12. The various elements associated with the mechanical springs 30 and 32 are substantially the same and therefore only those associated with the mechanical spring 30 will be described, it being understood that the other mechanical spring 32 operates in substantially the same manner.

Figure 5:
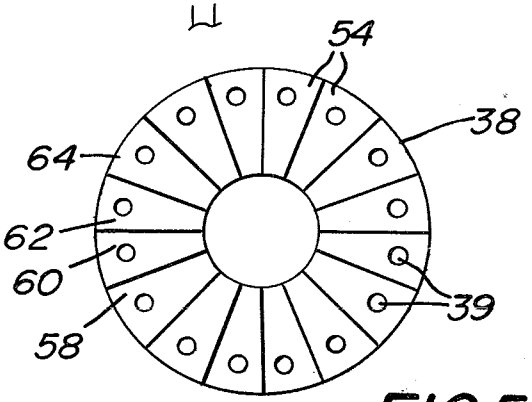
FIG. 5 is a view taken along lines 5—5 of FIG. 3.
Figure 4:
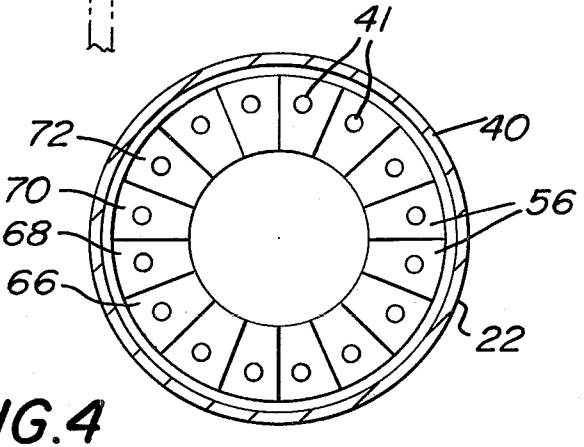
FIG. 4 is a view taken along lines 4—4 of FIG. 3.
Figure 3A:
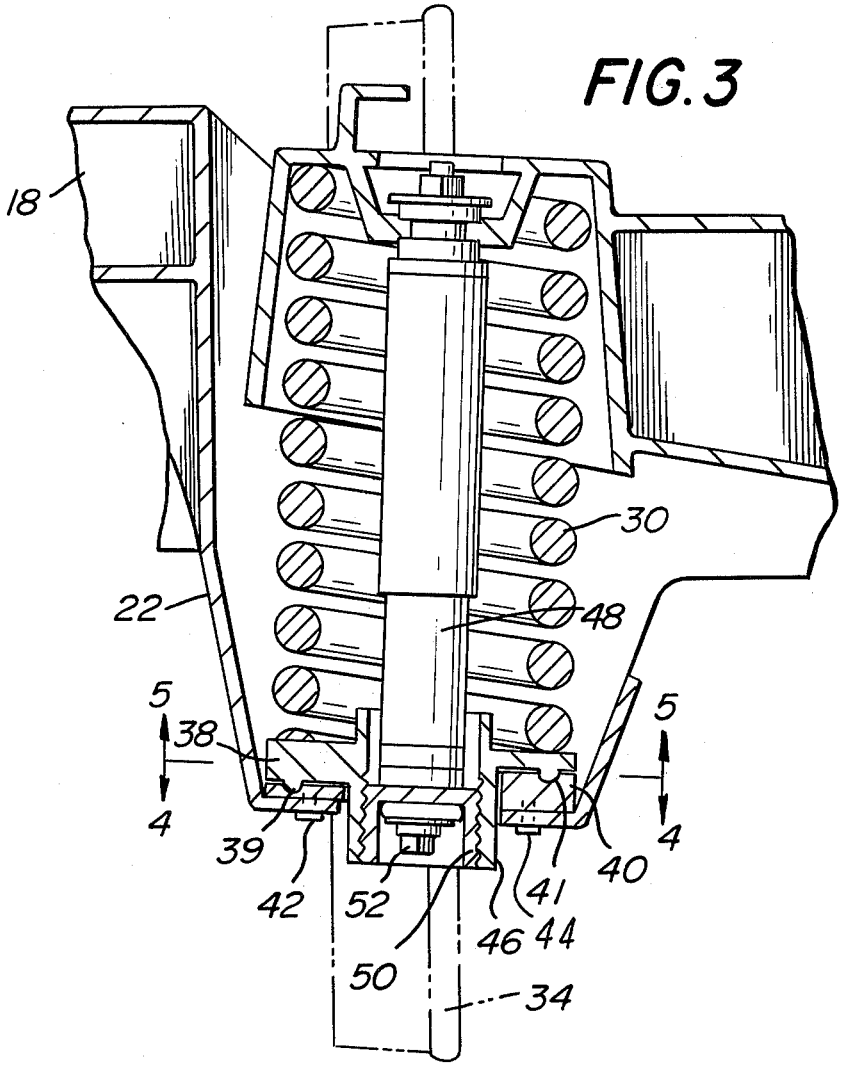
FIG. 3A illustrates a portion of the shock abosorber in FIG. 3 illustrating a different way of attaching the shock absorber in the mechanical spring.
Figure 3A:
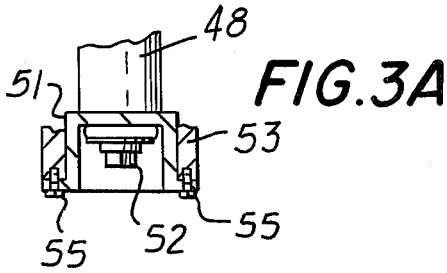

Referring to FIGS. 3, 4 and 5, the spring housing 22 includes the mechanical spring 30 disposed therein. In the embodiment illustrated, adjustment plates are located below the spring. In some cases, these plates may be located above the spring. The plates may be located at the top or bottom end of the spring while still permitting adjustments to be made in the height of the car body. The mechanical spring 30 is supported on a pair of adjustment plates comprising a top plate 38 and a bottom plate 40. The bottom plate 40 may be secured to the bottom portion of the housing by means of bolts 42 and 44. The top plate 38 may be selectively moved with respect to the bottom plate 40 by means of a wrench applied to a downwardly projecting portion 46 which extends beyond the spring housing 22.

The top plate 38 may be selectively moved to a number of positions as will be described and may include locating pins disposed in recesses (FIGS. 3 and 6) to locate and maintain the relative positions of the plates to prevent relative movements between the plates after they have been adjusted. The spring 30 is normally loaded by the weight of the car body 29. Consequently, the plate 38 is normally fixed with respect to the plate 40 during normal operation.

When it is necessary to readjust the height of the car body 28 and the mechanical spring 30, suitable jack means may be provided to remove the load of the car body 28 from the spring 30. With no loading on the spring, plate 38 may be removed from the locating pins and rotationally moved with respect to the bottom plate 40 by applying and turning a tool connected to the portion 46.

A shock absorber 48 is connected to a bottom threaded element 50 by means of a bolt 52. The threaded element 50 threadedly engages the inside of the downwardly extending portion 46 to permit insertion and removal of the shock absorber 48 by a suitable tool without disassembling any other parts in the spring or truck in the system.

FIG. 3A illustrates a slightly different way of connecting the shock absorber 48 within the spring. Instead of threaded portions on the sections 46 and 50, as in FIg. 3, the shock absorber includes a bottom element 51 mounted to an unthreaded downwardly extending sleeve portion 53 by means of mounting screws 55.

The top and bottom plates 38 and 40 include stepped portions 54 and 56, respectively, in the embodiment illustrated. It is conceivable, however, that only one plate would include stepped portions with the other plate having extending portions of the same height for engagement with the stepped portions. The number of stepped portions 54 and 56 in the embodiment illustrated, are the same for both plates. While the number of stepped portions may vary, in a preferred embodiment, there must be at least three of the stepped portions 54 resting on the stepped portions 56. In the figures illustrated, 16 portions are illustrated which means that there will be at least four resting places of the portions 54 and 56.

Figure 6:
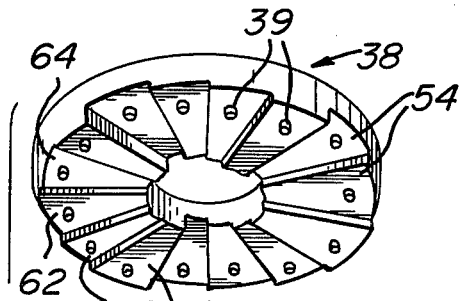
FIG. 6 is an exploded isometric view of a pair of adjustment plates in accordance with the present invention.

FIG. 6 illustrates details of the plates 38 and 40. Each of the plates 38 and 40 include the sixteen stepped potions. The plate 38 includes locating pins 39, which may be relatively short and wide dimensioned to fit into recesses 41 of the plate 40. At least four of the stepped portions of the top plate 38 are disposed to rest on four of the stepped portions of the bottom plate 40.

With no car loading, the pins 39 are lifted out of the recesses 41 to permit rotational movement of the plate 38. The plate 38 may be selectively moved with respect to the plate 40 thereby causing different sets of four stepped portions of the plate 38 to engage different sets of four different stepped portions of the plate 40. Depending on the particular stepped portions engaged between the plate, the top plate 38 will be disposed lower or higher than the bottom plate 40. The lowering or raising of the top plate 38 raises the level of the springs to thereby raise the level of the car 28 (FIG. 2).

Figure 7:
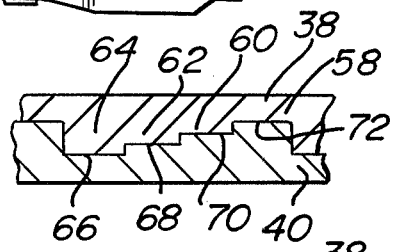
FIGS. 7, 8, 9 and 10 are cross-sectional views taken generally along lines 7—7 of FIG. 6 illustrating different relative positions of the adjustment plates.

Referring to FIG. 7, the top plate 38 is illustrated in its lowest position with respect to the bottom plate 40. In this position, the lower portions 58, 60, 62 and 64 of the plate 39 complement the corresponding rising portions 66, 68, 70 and 72. The most downwardly projecting step 64 of the plate 38 engages the lowest stepped portion 66 of the plate 40.

Figure 8:
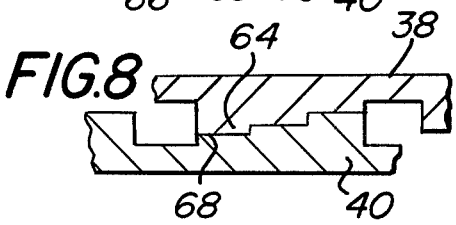

When the top plate 38 is rotated one step equal to the size of one partition, then a situation as illustrated in FIG. 8 will be present. In this case, the stepped portion 64 of the plate 38 will engage the stepped portion 68 of the plate 40 to thereby raise the top plate 38 and consequently the spring associated therewith. This also raises the height of the car body.

Figure 9:
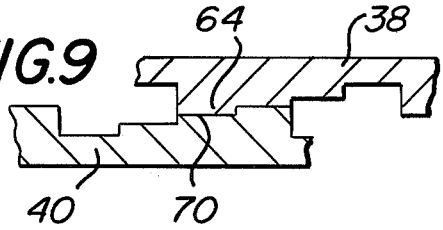

If the plate 38 is rotated a distance equal to another partition in a clockwise direction, a condition as illustrated in FIG. 9 will be present. In this case, the partition 64 of the plate 38 will engage with the portion 70 of the lower plate 40.

Figure 10:
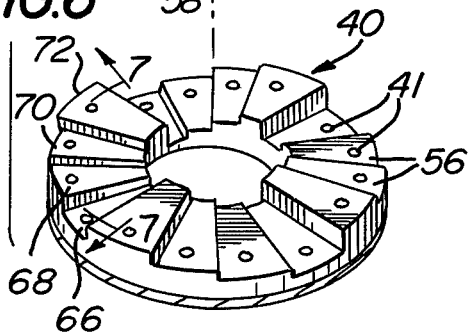
Figure 10:
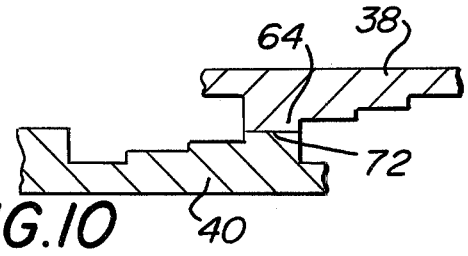

Finally, if the plate 38 is again rotated a distance equal to the size of one of the stepped portions, the portion 64 will engage the highest portion 72 of the plate 40, as illustrated in FIG. 10.

The most downwardly extending four portions, such as the portion 64, of the top plate 38 will physically contact a selected set of bottom portions in the plate 40, such as 66, 68, 70 and 72. The particular set of bottom portions contacted by the four portions of the top plate 38, such as the portion 64, will determine the height of the spring and consequently car level of the car body.

As mentioned, 16 stepped portions are illustrated in each of the plates 38 and 40. This means that all portions will correspond to 90° in the plates. Also, it means that the four portions of the upper plate 38 will contact four portions of the lower plate 40.

If desired, only 12 stepped portions could be involved. In this case, three sets of three stepped portions would be provided instead of the four steps illustrated. In this case, one set of three stepped portions would comprise 120°, with each portion being 40°. Each movement of the upper plate a distance of 40° determining a different height for the spring and car body involved. It is necessary for stability that three portions of the upper plate rest on at least three portions on the lower plate.

What is claimed is:

1. In combination with a railway car body supported by cylindrical mechanical springs on a truck including wheel-axle units, means for adjusting the height of said railway car to compensate for wear of the wheels in said wheel axle units comprising:

(a) a housing mounted to said truck for receiving, securing, and centering one of said springs therein;

(b) top and bottom adjustment plates disposed at one end of said spring;

(c) at least one of said top and bottom adjustment plates including a plurality of equally spaced stepped portions disposed to selectively contact at least one projecting portion of the other plate, (d) means for relatively moving said top and bottom plates with respect to each other to selectively cause the stepped portions of said one of said top and bottom plates to engage the projecting portion of the other plate, (e) a shock absorber dimensioned to pass through center openings in said top and bottom adjustment plates and connected to said housing inside of said spring, and (f) removable means for securing said shock absorber in said openings and disassembling said shock absorber from said housing.

* * * * *